US007758398B2

(12) United States Patent
Park

(10) Patent No.: US 7,758,398 B2
(45) Date of Patent: Jul. 20, 2010

(54) JOINING APPARATUS WITH ROTATABLE MAGNET THEREIN AND BUILT-UP TYPE TOY WITH THE SAME

(75) Inventor: Kyung-Hwa Park, Seoul (KR)

(73) Assignee: Orda Korea Co., Ltd. (KR)

( * ) Notice: Subject to any disclaimer, the term of this patent is extended or adjusted under 35 U.S.C. 154(b) by 324 days.

(21) Appl. No.: 11/972,052

(22) Filed: Jan. 10, 2008

(65) Prior Publication Data

US 2008/0113579 A1 May 15, 2008

Related U.S. Application Data

(63) Continuation of application No. 10/542,276, filed on Jul. 14, 2005, now Pat. No. 7,320,633.

(51) Int. Cl.
*A63H 33/04* (2006.01)
*A63H 33/00* (2006.01)

(52) U.S. Cl. ..... 446/92; 446/131; 446/138

(58) Field of Classification Search ..... 446/85, 446/92, 129, 131, 134, 138; 273/156
See application file for complete search history.

(56) References Cited

U.S. PATENT DOCUMENTS

| | | | | |
|---|---|---|---|---|
| 2,665,913 | A * | 1/1954 | Hlavac | 273/239 |
| 3,278,011 | A * | 10/1966 | Viemeister | 206/457 |
| 5,347,253 | A * | 9/1994 | Ogikubo | 335/302 |
| 5,746,638 | A * | 5/1998 | Shiraishi | 446/92 |
| 6,017,220 | A * | 1/2000 | Snelson | 434/301 |
| 6,431,936 | B1 * | 8/2002 | Kiribuchi | 446/92 |
| 6,749,480 | B1 * | 6/2004 | Hunts | 446/92 |

FOREIGN PATENT DOCUMENTS

| | | |
|---|---|---|
| JP | 11-047435 | 2/1999 |
| JP | 2002-159761 | 6/2002 |
| KR | 1979-0000316 | 3/1979 |
| KR | 1983-0000772 | 5/1983 |
| KR | 1998-068823 | 12/1998 |
| KR | 1999-008496 | 3/1999 |
| KR | 20-0204465 | 9/2000 |
| KR | 2000-0018450 | 10/2000 |
| KR | 2001-0028465 | 4/2001 |
| KR | 20-0250911 | 10/2001 |
| KR | 20-0263127 | 1/2002 |
| KR | 20-0274456 | 4/2002 |

* cited by examiner

*Primary Examiner*—Kien T Nguyen
(74) *Attorney, Agent, or Firm*—Ostrolenk Faber LLP

(57) ABSTRACT

Disclosed is a built-up type toy having plural parts 10*a* of polyhedron shape equipped with joining surfaces 11*a* that are joined with other joining surfaces 11*b* of other parts 10*b*.

The built-up type toy of the present invention has the parts respectively having magnet portions 100*a* on the joining surfaces 11*a* thereof, wherein the magnet portion 100*a* of the part 10*a* and the magnet portion 100*b* on the joining surface 11*b* of the parts 10*b* are joined with each other by magnetic force thereof.

The built-up type toy of the present invention provides the effects that it is easy to assemble and disassemble, the assemble state is not likely to be demolished easily, and it is helpful to develop the initiative of infant as it can be assemble to various shapes.

14 Claims, 17 Drawing Sheets

JOINING APPARATUS WITH ROTATABLE MAGNET THEREIN AND BUILT-UP TYPE TOY WITH THE SAME

CROSS REFERENCE TO RELATED APPLICATION

This application is a continuation of U.S. application Ser. No. 10/542,276, filed Jul. 14, 2005, entitled JOINING APPARATUS WITH ROTATABLE MAGNET THEREIN AND BUILT-UP TYPE TOY WITH THE SAME, which is a 35 U.S.C. §§371 national phase conversion of PCT/KR2004/000048, filed Jan. 14, 2004, which claims priority of Korean Patent Application No. 10-2003-0002395, filed Jan. 14, 2003, and Korean Patent Application No. 10-2003-0016688, filed Mar. 18, 2003, the disclosure of which has been incorporated herein by reference.

FIELD OF THE INVENTION

The present invention relates to a built-up type toy, and more particularly, to a built-up type toy capable of being assembled and disassembled so as to be used as a toy and an educational tool for infant.

BACKGROUND OF THE INVENTION

As a built-up type toy, there are a type that can be assembled and disassembled easily without any adhesive such as a piling-up type toy or an assemblage type toy, and a type that cannot be disassembled after being assemble using adhesive such as a plastic model.

Furthermore, among the former type of built-up type toy that does not use the adhesive, there has been developed a toy that a character, a symbol, a diagram or any other kinds of shape is configured by assembling the respective parts so as to be used for the education of the infant.

However, the built-up type toy that does not use the adhesive has the problems that the assembled shape can be easily demolished even by a slight impact to the assembled shape as the joint of the parts is not steadfast, and if the mechanical joining structure is adopted to prevent such a shortcoming, the lifetime of the product becomes short by the repetitive assembling and disassembling.

In particular, in the case of the built-up type toy provided for the purpose of education of the infant as described above, considering the aspect that it is handled by the infant who is not delicate in the hand movement and not careful sufficiently, the fact that it is not easy to assemble and the assembled shape can be demolished easily has been a serious problem to be solved for a long period of time in the infant toy industry.

Furthermore, in the case of the structure that employs the assembling fashion to pile up a various shape of parts such as Lego, the assembled structure can be realized under the restriction that the center of weight is kept as there is not provided a separate joining structure on the joining surface of the parts, which has been another problem that the toy useful for the education to develop the initiative of the infant cannot be provided.

DETAILED DESCRIPTION OF THE INVENTION

The present invention has been proposed to overcome the above-described problems, and it is an object of the present invention to provide a built-up type toy having the structure that is easily assembled and disassembled and is not demolished easily from the assembled state thereof, and is capable of being assembled to a variety of shapes to be helpful to the development of the initiative of infant.

According to one aspect of the present invention, to achieve the above-described object, there is provided a built-up type toy having a plurality of parts of polyhedron shape equipped with joining surfaces that are joined with other joining surfaces of other parts, the built-up type toy comprising the parts respectively having magnet portions on the joining surfaces thereof, wherein the magnet portion of the part and the magnet portion on the joining surfaces of the parts are joined with each other by magnetic force thereof.

Here, the magnet portion can have the construction that it is formed on a central area of the joining surface of the part, a plurality of magnet portions are provided on the respective joining surfaces of the part, the magnet portion is provided on all of the surfaces of the part, or the magnetic portion is formed on the edge area of the joining surface of the part.

Further, the parts can be constructed to form a character, a number, a symbol, a diagram, or a certain shape on a plane thereof as the parts are joined with other parts, the parts can be comprised of a plurality of hexahedrons having shapes and sizes identical to each other, the parts realize a variety of three-dimensional shapes as being joined with other parts, and the parts can realize a variety of three-dimensional shapes as being joined with other parts. Furthermore, the parts can be comprised of: a rotational shaft part having a shape of a bar and formed with the magnet portions on both ends thereof; and a wheel part formed with the magnet portion joined with the magnet portion of the rotational shaft part on a central area thereof, and alternatively, or can be comprised of: a fragmental part having a detached shape achieved by detaching a section from an overall shape of joined product; and a body part having a residuary shape achieved by detaching the fragmental parts from the overall shape of the joined product.

The part can also be comprised of: a central part having a circular transverse section and having a plurality of magnet portions arranged on an outer surface thereof at a predetermined interval; and a plurality of fragmental parts having a fan-shaped transverse section, the fragmental parts respectively having a magnet portion corresponding to the magnet portion on the outer surface of the central part, and magnet portions being joined with the magnet portions of other fragmental parts on both side thereof, wherein a cylindrical shape is formed as the central part is located on a central position and inner surfaces of the plurality of fragmental parts are joined on the outer surface of the central part.

Meanwhile, according to another aspect of the present invention, to achieve the above object of the present invention, there is provided a built-up type toy comprising: the parts respectively having magnet portions on the joining surfaces thereof; wherein the magnet portion of the part and the magnet portion on the joining surface of the parts are joined with each other by magnetic force thereof, and wherein the magnet portion comprises: a magnet of which both magnetic poles are arranged to face directions different from each other, the magnet being installed on a magnet installation recess formed on the part; and a separation preventing means for preventing a separation of the magnet from the magnet installation recess while allowing a rotation of the magnet in the inner space of the magnet installation recess.

In such a situation, the separation preventing means is comprised of: a rotational shaft installed on a central area between both of the magnetic poles of the magnet; and a rotational shaft installation recess formed on an inner surface of the magnet installation recess so that the rotational shaft is parallel with an outer surface of the part, or comprised of: a pair of recesses formed on surfaces opposite to each other at a central area of both poles of the magnet; and a pair of rotational shaft protrusions formed on an inner surface of the magnet installation recess so as to be inserted into the pair of recesses while a virtual line connecting central positions of the pair of recesses to each other is in parallel with an outer surface of the part.

The magnet can be made of a permanent magnet of cylindrical shape.

Furthermore, the separation preventing means can have a hooking protrusion for preventing the separation, which is formed on an opening of the magnet installation recess, wherein an inner diameter of the opening formed by the hooking protrusion is narrower than a width and a length of the magnet.

It is preferable that the magnet further comprises joining protrusions on both magnetic poles thereof, of which an outer diameter is smaller than the inner diameter of the opening.

The separation preventing means can be constituted by a sealing lid for closing the opening of the magnet installation recess.

In such a situation, a lid installation recess can be formed on a rim of the opening of the magnet installation recess, the lid installation recess on which the sealing lid is installed.

The magnet can be a cylindrical permanent magnet or a spherical permanent magnet.

Here, the magnet installation recess and the sealing lid are formed integrally on the outer surface of the part, the magnet is inserted after cutting the part, and the separation of the magnet is prevented by attaching a cut piece on the part. The part is made of wood.

Further, the separation preventing means can be constituted by a magnet installation member inserted into the magnet installation recess, the magnet installation member comprising: a circumferential portion of which surface is in contact with the magnet installation recess; and a lid portion that closes an upper opening of the circumferential portion.

Preferably, the magnet installation member further comprises a means for fixing the magnet installation member into the magnet installation recess.

Here, the magnet installation member fixing means can be constituted by a fixing wedge portion extended downward of the circumferential portion so as to be inserted and fixed onto the bottom surface of the magnet installation recess.

Furthermore, the magnet installation member fixing means can be constituted by a hooking protrusion formed outward on an outer surface of the circumferential portion toward the lid portion.

Here, the hooking protrusion can be an overall hooking protrusion formed over all area of the outer surface of the circumferential portion at a shape of a wedge, or a partial hooking protrusion formed on a partial area of the outer surface of the circumferential portion.

In such a situation, the partial hooking protrusion is formed by cutting and bending a part of the circumferential portion.

Furthermore, the hooking protrusion can be a lower hooking protrusion formed on a lower end area of the outer surface of the circumferential portion. It is preferable to further comprise a tilted portion that is tilted downward and inward from the lower hooking protrusion at a certain degree.

Here, the lower hooking protrusion and the tilted portion are formed integrally with each other by bending a lower portion of the circumferential portion.

Furthermore, the magnet installation member fixing means can be constituted by a screw thread formed on the outer surface of the circumferential portion.

The magnet installation member fixing means can be constituted by a fixing tool insertion recess so formed on an upper surface of the lid portion as to insert the magnet installation member into the magnet installation recess by rotating the magnet installation member with a magnet installation member fixing tool.

Here, the fixing tool insertion recess is an insertion recess having a circular transverse section.

In that situation, a plurality of insertion recesses having the circular transverse section are formed in a radial fashion.

The fixing tool insertion recess can be an insertion recess having a cross-shaped transverse section.

Furthermore, the construction of the magnet portion, the parts, etc. can be modified to a variety of manners as described above.

Meanwhile, according to the present invention, a joining apparatus with rotatable magnet that can be employed in the built-up type toy having the above construction is provided.

The joining apparatus with rotatable magnet comprises: a magnet of which both magnetic poles are arranged to face directions different from each other, the magnet being installed on a magnet installation recess formed on the part; and a separation preventing means for preventing a separation of the magnet from the magnet installation recess while allowing a rotation of the magnet in the inner space of the magnet installation recess.

Furthermore, the construction of the magnet, the separation preventing means, etc. can be modified to a variety of manners as described above.

BRIEF DESCRIPTION OF THE DRAWINGS

FIGS. 1 through 33 show embodiments of the present invention, in which:

FIG. 1 is a perspective view of the respective parts of the built-up type toy;

FIG. 2 is an exploded perspective view;

FIGS. 3 through 5 are perspective views of the embodiment where the present invention is employed for the education of characters as a planar structure;

FIGS. 6 through 8 are perspective views of the embodiment where the present invention is employed for the education of calculation as a planar structure;

FIGS. 9 and 10 are perspective views of the embodiment where the magnets are disposed on the edge area of a part;

FIGS. 11 through 15 are perspective views of the embodiment where the present invention is realized as a three-dimensional structure;

FIG. 16 is a perspective view of the first embodiment of the joining apparatus with rotatable magnets;

FIG. 17 is a transverse sectional view of the first embodiment of the joining apparatus with rotatable magnets;

FIG. 18 is a transverse sectional view of the second embodiment of the joining apparatus with rotatable magnets;

FIG. 19 is a transverse sectional view of the third embodiment of the joining apparatus with rotatable magnets;

FIG. 20 is a perspective view of the third embodiment of the joining apparatus with rotatable magnets;

FIG. 21 is a transverse sectional view of the fourth embodiment of the joining apparatus with rotatable magnets;

FIG. 22 is a perspective view of the fifth embodiment of the joining apparatus with rotatable magnets;

FIG. 23 is an exploded perspective view of the fifth embodiment of the joining apparatus with rotatable magnets;

FIG. 24 is a perspective view of the sixth embodiment of the joining apparatus with rotatable magnets;

FIG. 25 is an exploded perspective view of the seventh embodiment of the joining apparatus with rotatable magnets;

FIG. 26 is a perspective view of the first modification of the magnet installation member;

FIG. 27 is a perspective view of the second modification of the magnet installation member;

FIG. 28 is a transverse sectional view of the second modification of the magnet installation member;

FIG. 29 is a perspective view of the third modification of the magnet installation member;

FIG. 30 is a transverse sectional view of the third modification of the magnet installation member;

FIG. 31 is a perspective view of the fourth modification of the magnet installation member;

FIG. 32 is a perspective view of a tool for fixing the magnet installation member; and FIG. 33 is a perspective view of the fifth modification of the magnet installation member.

PREFERRED EMBODIMENT OF THE INVENTION

Hereinbelow, the present invention is described in greater detail with reference to the accompanying drawings.

Figure 1:
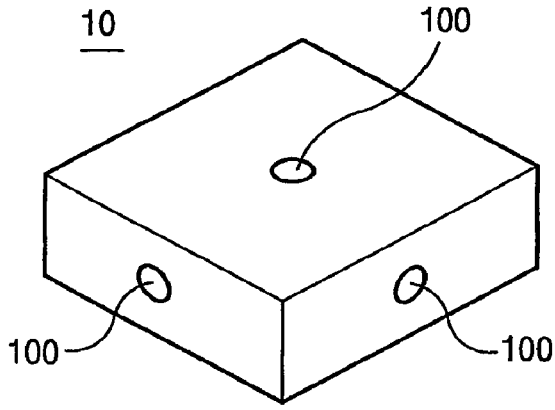
Figure 2:
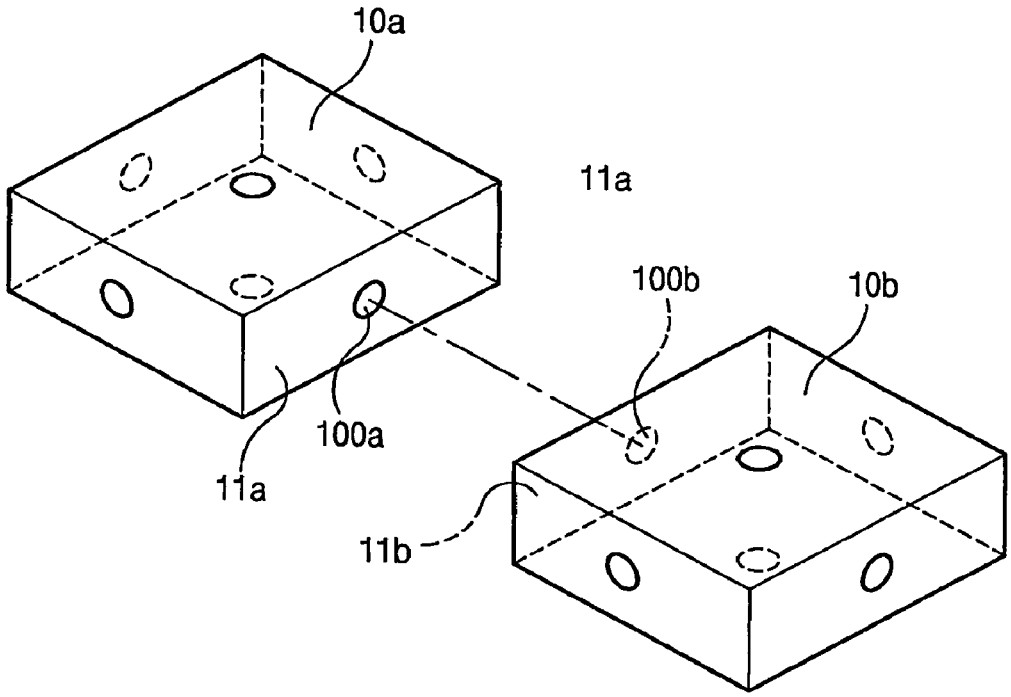

As shown in FIGS. 1 and 2, the built-up type toy according to the present invention is basically the same as the conventional art in the aspect that it is constituted by a plurality of parts 10*a* having the shape of polyhedron with the joining surfaces 11*a* capable of being joined with other joining surfaces 11*b* of other parts 10*b*, however, it is characterized in that the part 10 is formed with the magnet portions 100*a* on the joining surfaces 11*a* thereof, and the magnet portion 100*a* of the part 10*a* is assembled with the joining surface 11*b* of other part 10*b* by the magnetic force.

In other words, in the built-up type toy having the construction that the respective parts 10 are joined simply with each other without any adhesive, the respective joining surfaces of respective parts 10 are formed with the magnetic portions 100.

Therefore, there are provided effects that the parts 10 are easily assembled by the magnetic force of the magnet portion 100 in the aspect of the assemblage of the toy, and the disassembly can be easily performed even with a weak power of infant as the intensity of the magnetic force of the magnetic portion 100 is adjusted in the aspect of the disassembly of the toy, and furthermore, the assembled shape is not demolished easily as in the case of the conventional art.

Any position on the joining surface 11 of the part 10 will to as the location of the magnetic portion 100, however, it is preferable that the magnet portion 100 is arranged on the central area of the joining surface 11 for a stabler joint since the magnetic force of the magnet portion 100 cannot restrict the relative rotation of both parts 10.

Furthermore, one magnet portion 100 on each of the joining surface 11 of the part 10 will do, however, it is preferable that a plurality of magnetic portions 100 are formed on each of the joining surface 11 in case the size of the part 10 is relatively great in comparison with the size of the magnet portion 100, in case the relative rotation of both parts 10 has to be restricted, etc.

Furthermore, it is sufficient that the magnet portion 100 is formed only on the joining surfaces 11 that are to be used for the joining of the respective parts 10, however, it is preferable that the magnet portion 100 is formed on all of the surfaces 11 of each part 10 which has the shape of the polyhedron, in consideration of the aspect that the user can make an assembled shape that the manufacturer did not expect, or the aspect that parts 10 can be preserved while being piled up at an arbitrary shape.

Such a joining structure can be adopted to any cases of built-up type toys unless they do not use the adhesive, and hereinbelow, the built-up type toy according to the present invention will be described as being classified to the cases that the built-up type toy is realized by a planar construction such as a puzzle toy and the built-up type toy is realized by a three-dimensional construction such as a Lego toy.

In case the built-up type toy of the present invention is realized as a planar construction, in consideration of the above-mentioned effects collectively, it is possible that the parts 10 displays a character, a number, a symbol, a diagram, or any kinds of shape on the plane thereof as they are assembled with each other so as to be used for the education of infant.

Figure 3:
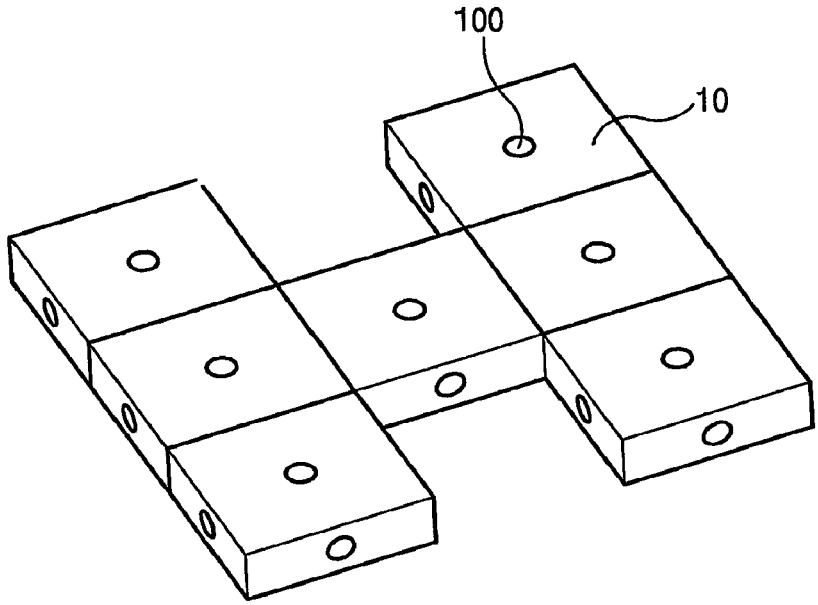
Figure 4:
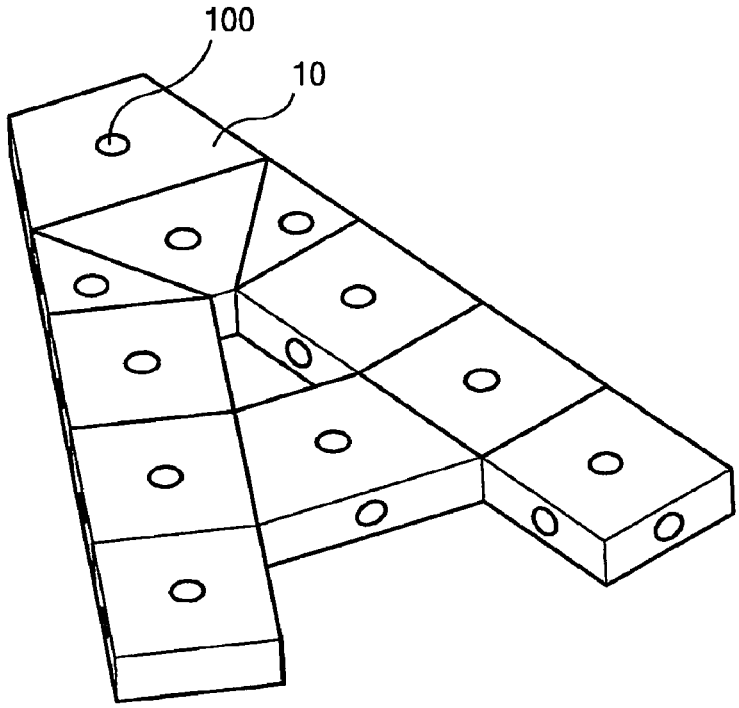
Figure 5:
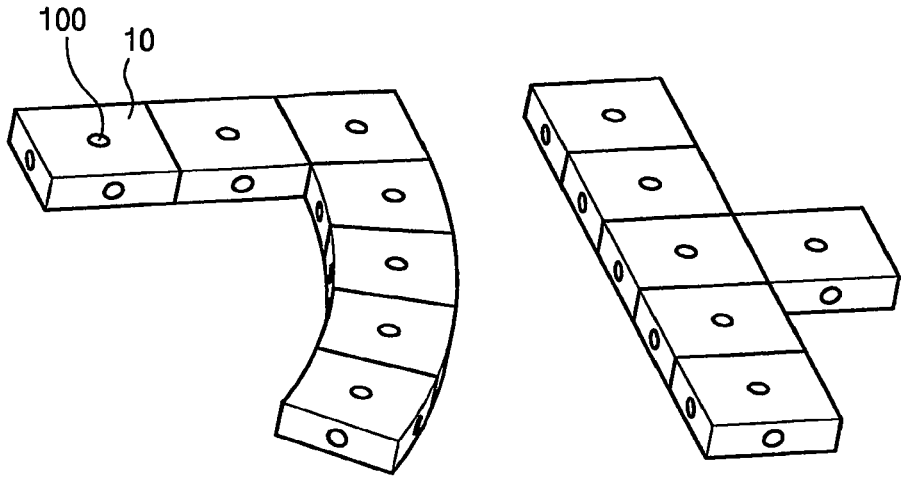

FIGS. 3 through 5 show the embodiment where the built-up type toy according to the present invention is employed for the education of character of the infant.

If the respective parts 10 are constituted by a plurality of hexahedron having the shape and size identical to each other, the character, the number, etc. can be expressed by a simple manner as shown in FIG. 3.

If the constitution of the character becomes complex as the curves are added besides the straight lines and the angles between the lines in each character are changed diversely, a variety of characters can be expressed by making the size of the parts 10 small, and furthermore, as shown in FIGS. 4 and 5, a variety of characters can be expressed while being maintained to a proper size by making the size of the respective parts 10 different from each other.

The built-up type toy according to the present invention can be used for the education of the character, the number, etc. as described above as well as for the education of calculation as will be described below.

Figure 6:
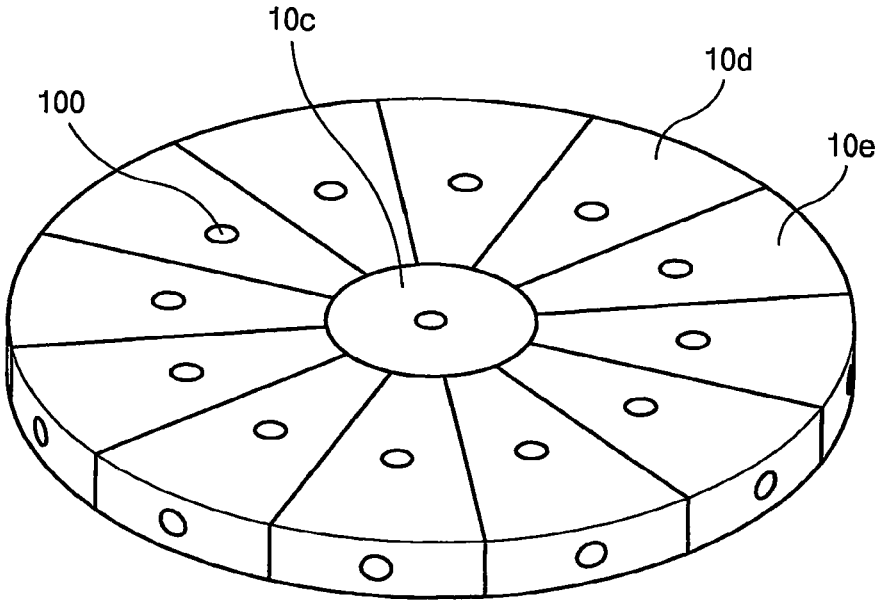
Figure 7:
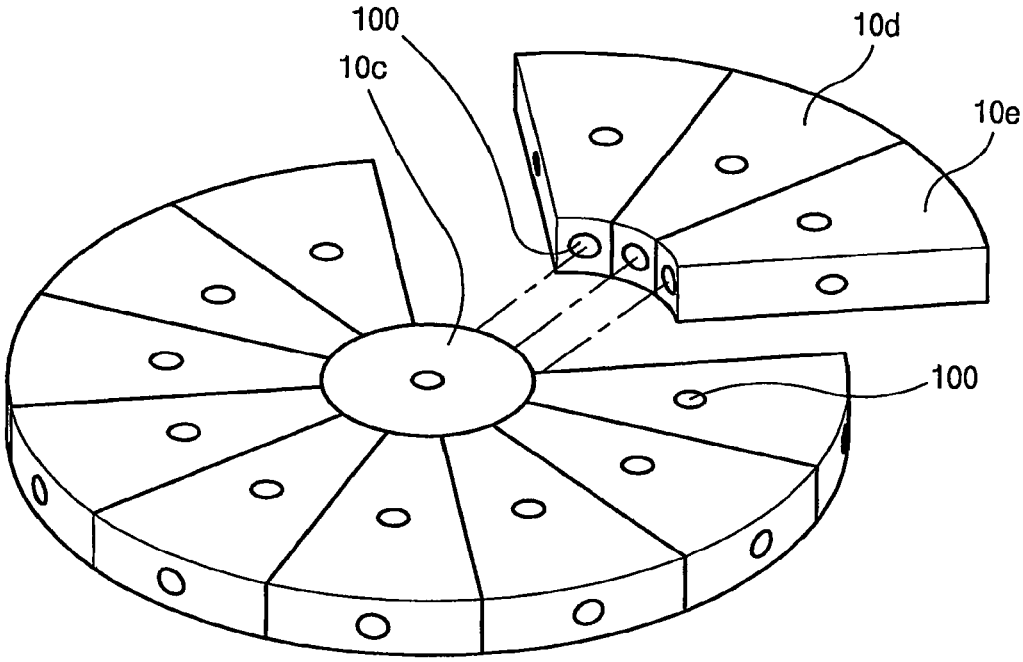
Figure 8:
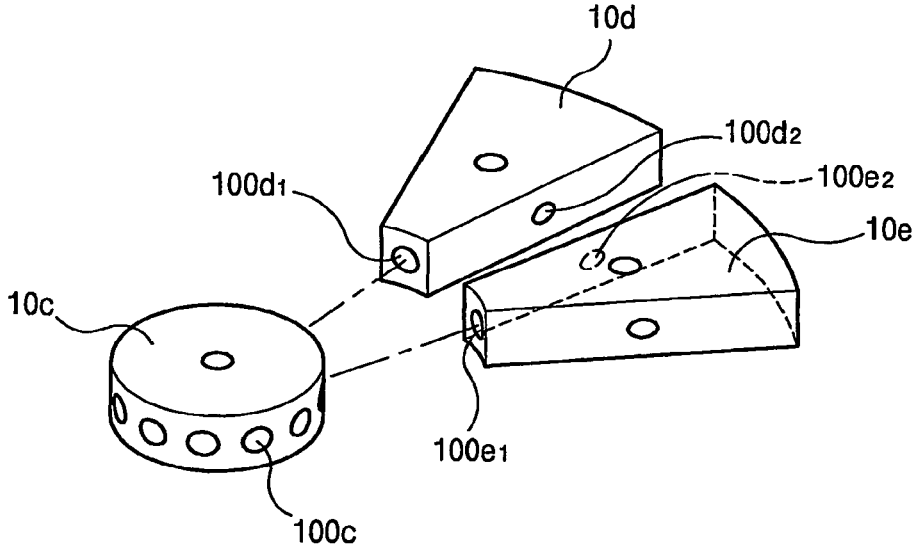

In other words, as shown in FIGS. 6 to 8, such a constitution is comprised of a central part 10*c* formed with a plurality of magnet portions 100 on the outer surface thereof at a predetermined interval, and a plurality of fragmental parts 10*d* and 10*e* respectively formed with the magnet portions 100*d*2 on both sides thereof so as to be joined with the magnet portions 100*e*2 of other fragmental parts 10*e*.

In such a constitution, as the central part 10*c* is located on a central position and the inner sides of the plurality of fragmental parts 10*d* and 10*e* are joined with the outer surface of the central parts 10*c* to form a cylindrical shape, a part of the fragmental parts among the overall fragmental parts can be simply assembled or disassembled, which will lead the infant to learn the concept of fractional number easily with interest.

Next, when the built-up type toy according to the present invention is realized as a three-dimensional construction, an arbitrary shape can be formed free as the demolition that may be caused by the gravitation can be prevented by the function of the magnet portions 100, so the toy can be used for the purpose of development of the initiative of infant.

Figure 9:
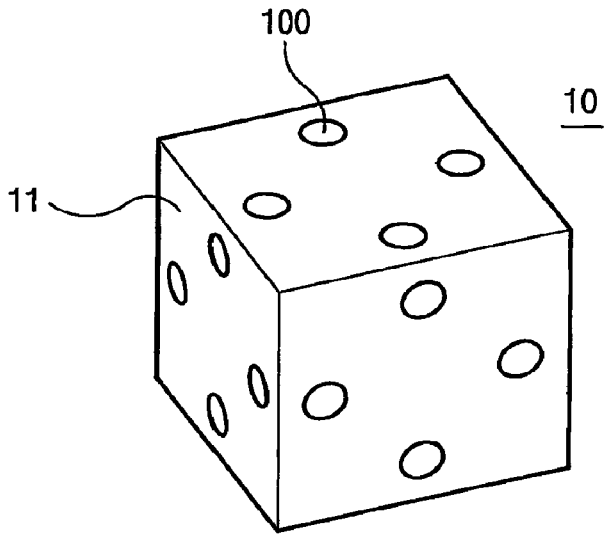
Figure 10:
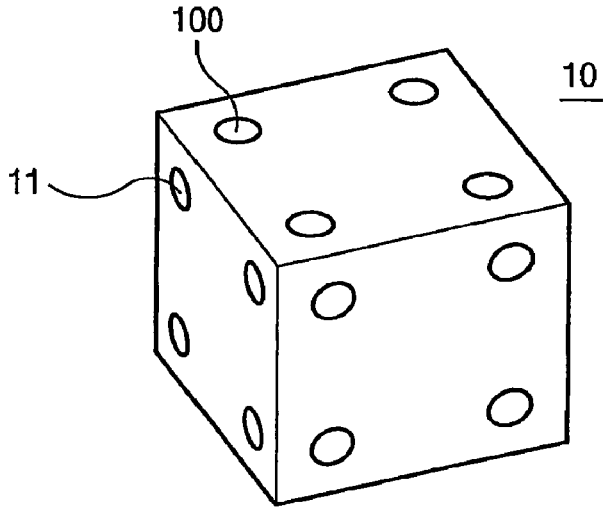
Figure 11:
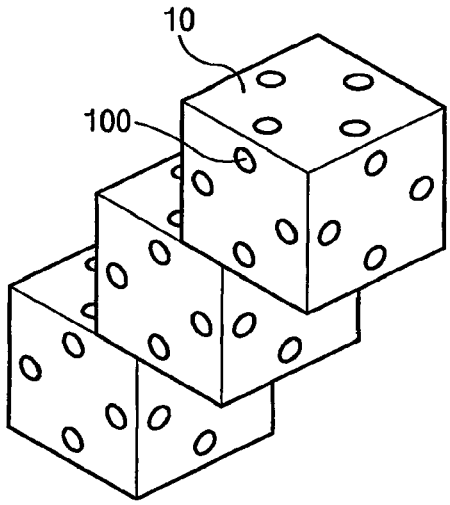
Figure 12:
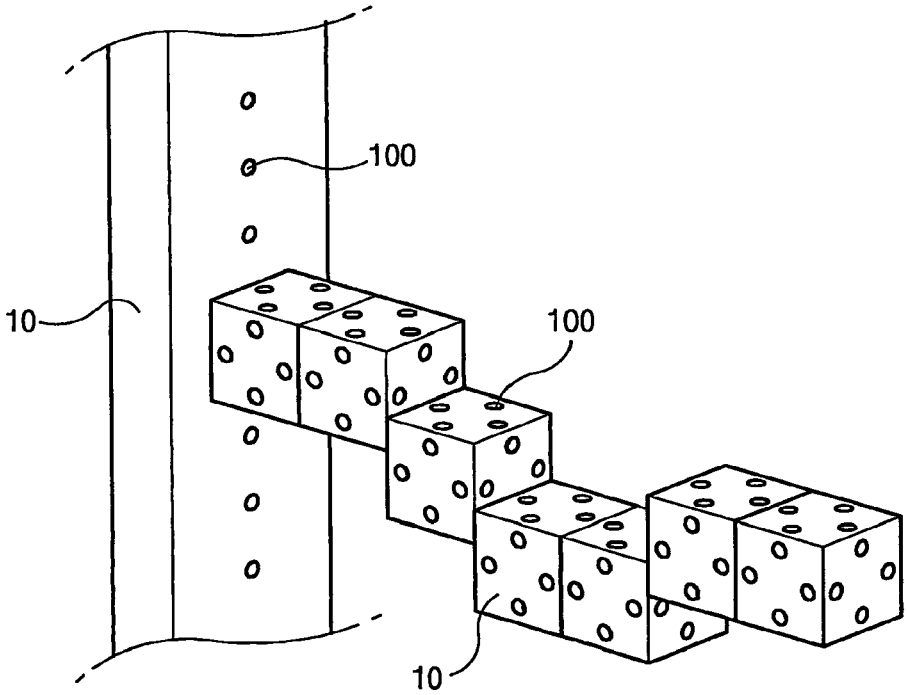
Figure 13:
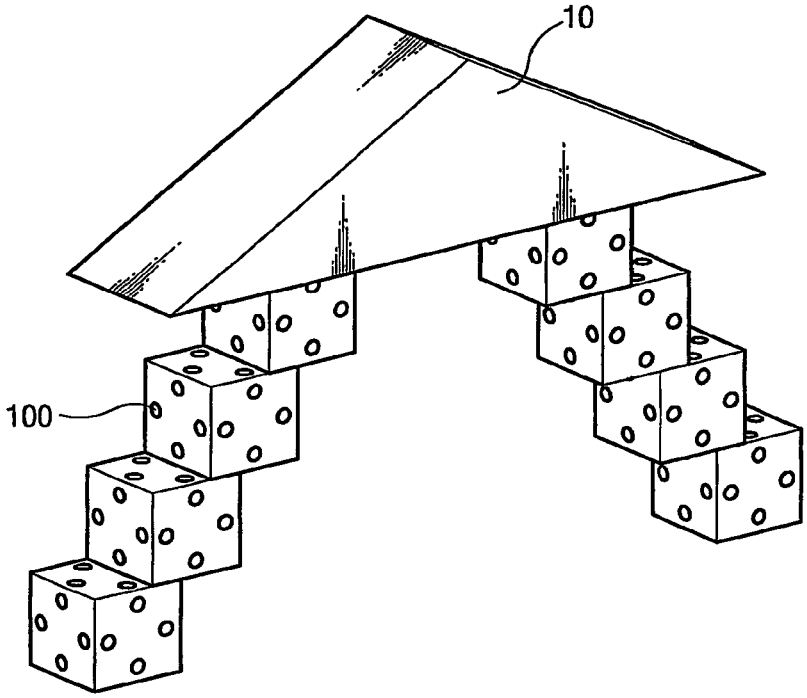

In other words, in the case of the built-up type toy such as a Logo toy that is not equipped with a separate adhesive mechanism such as the adhesive, the assembly may be demolished instantly unless a stable mechanism is not constituted, so there is a restriction in forming a structure with the built-up type toy parts, however, as shown in FIGS. 9 and 10, as the magnet portions 100 are disposed on the edge area of the joining surfaces 11 of the part 10 and the parts with such a construction are assembled with each other, it is possible to easily construct a structure that is unstable mechanically as shown in FIGS. 11 to 13.

For such a purpose, it is required that the magnet portions 100 of the respective parts 10 are arranged not on the central area but on the edge area of the joining surfaces 11 of the part 10, and for the assemblage of freer construction, it is preferable that a plurality of magnet portions 100 are formed on each joining surface 11 or all of the surfaces 11 of the part 10.

When the above-described construction is employed, the trapezoidal structure as shown in FIG. 11 that is unstable mechanically can be constructed without any adhesive or any separate adhesive mechanism, the cantilever structure that a stalk is protruding from a wall as shown in FIG. 2 can be constructed, and various shapes of building or other three-dimensional construction can be constructed with various shapes of parts as shown in FIG. 13.

Since the toy provides the convenience that an arbitrary three-dimensional shape can be assembled without any restriction regarding to the mechanical stability, it provides prominent effect in the aspect of education that the initiative of infant can be developed effectively in comparison with the conventional built-up type toy.

Furthermore, it is free to assemble or disassemble the parts when the construction of the present invention is employed, so if the present invention is employed in a general conventional assemblage construction, the kind of the shape that can be formed by the simple parts can be much diverse.

Figure 14:
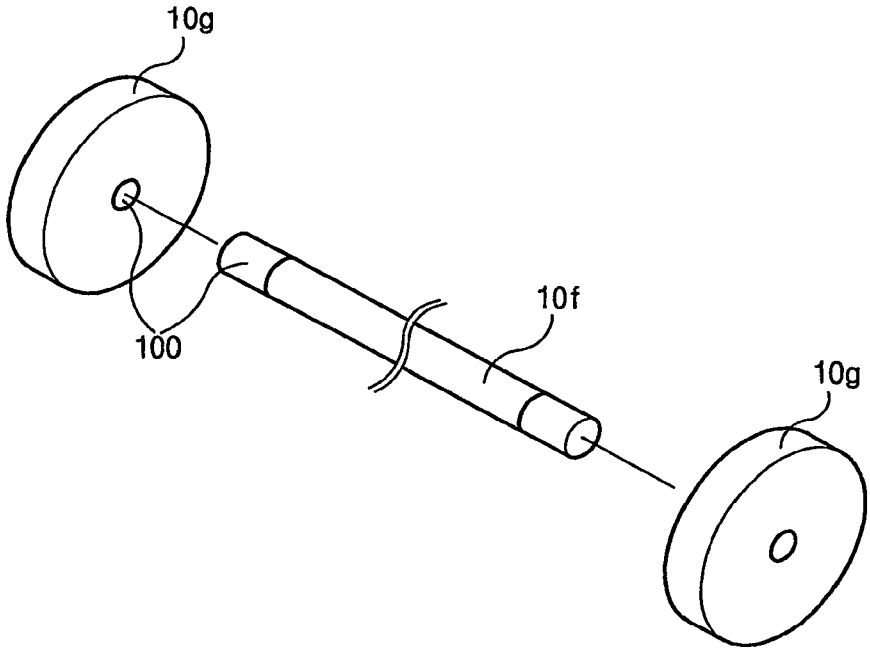

For example, as shown in FIG. 14, if the construction that is comprised of a rotational shaft part 10*f* having the shape of a bar formed with magnetic portions 100 on both ends thereof, and a wheel part 10*g* formed with a magnet portion 100*g* for being joined with the magnetic portion 100*f* of the rotational shaft part 10*f* on the central area thereof, a wheel assembly can be realized with simple parts of cylindrical shape.

Furthermore, if a product of a certain shape is prepared in advance and the product is divided into a body part and a fragmental part, the infant can enjoy more initiative games.

Figure 15:
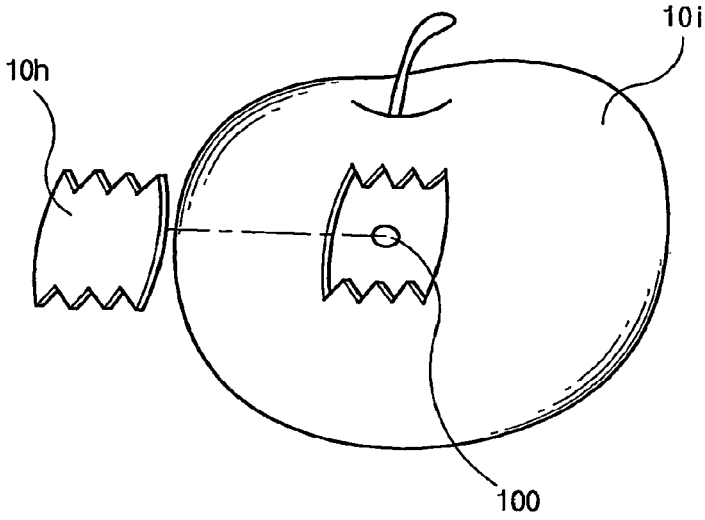

For example, as shown in FIG. 15, when the product is shaped into a fruit, wherein the product is comprised of a fragmental part 10*h* having the shape of a piece detached from the overall shape of the product, and the body part 10*i* having the shape of residuary portion that the fragmental part 10*h* has been detached from the overall shape of the product, the infant can enjoy the game to cut and eat the fruit.

As the built-up type toy of the present invention has the construction that it is assembled to an arbitrary shape as mentioned above, when an adult such as the parents tell a story to the infant, it is possible to construct a character, an animal, a building, etc., whereby the concentration of infant on the story can be induced and the initiative can be developed more effectively.

Meanwhile, the material of the piling-up type toy for the infant is generally wood or plastic that is not harmful to a human body in order to make any hazard to the infant even when the infant sucks the parts.

Since the present invention is proposed under the object that an unstable arbitrary shape can be assembled free by the magnetic force of the magnet portion 100, it is preferable that the gravitation of the part 10 itself is as small as possible in comparison with the magnetic force of the magnet 110.

Accordingly, it is possible that the inside of the part 10 is vacant and the body is made of light plastic.

Meanwhile, as the respective part 10 is formed to have a polyhedron shape, it also has a plurality of joining surfaces, wherein it is preferable that the number of joining surfaces that the magnet portions 100 are prepared is as great as possible in order to provide diverse assembled shapes.

However, in such a construction, there will not be any serious problem if the poles of both joined magnet portions 100 are different from each other, but there will be the problem that they are not joined with each other if the poles thereof are the same with each other since a repulsive force is generated between them.

In other words, there will be no problem if the magnet portions 100 are constructed to induce the attractive force between the joining surfaces when the parts 10 are joined with each other, however, when a certain shape that was not expected by the manufacturer is by be constructed, there may occur a situation that the poles of the magnet portions 100 are not conformed to each other in constructing a different shape of product with the same parts 10.

In order to provide against such a situation, it is preferable that the magnet portions 100*a* of the respective parts 10*a* are constructed so that the attractive force is generated with respect to the magnet portions 100*b* of other part 10*b* in any situation.

Accordingly, as shown in FIGS. 16 to 33, it is preferable that the magnet portion 100 of the present invention is constructed so that both poles thereof face the directions different from each other, and it is preferable to include a magnet 110 installed in the magnet installation recess 120 formed on the part 10, and a separation preventing means 200 for preventing the separation of the magnet 110 from the magnet installation recess 120 while allowing the rotation of the magnet 110 in the inner space of the magnet installation recess 120.

In other words, the magnet 110 that is installed in the inner space of the magnet installation recess 120 formed on the part 10 and allowed to rotate therein while the separation thereof is prevented is rotatable free in the inner space, wherein a rotational force is induced by the repulsive force between both of the magnets 100 when the poles of both magnet portions 100 joined with each other become the same, so the construction that generates the attractive force by the different poles of both magnet portions 100 is made automatically.

In such a situation, the separation preventing means 200 for preventing the separation of the magnet 110 while allowing the rotation of the magnet 110 can be realized by a variety of embodiments described below.

Figure 16:
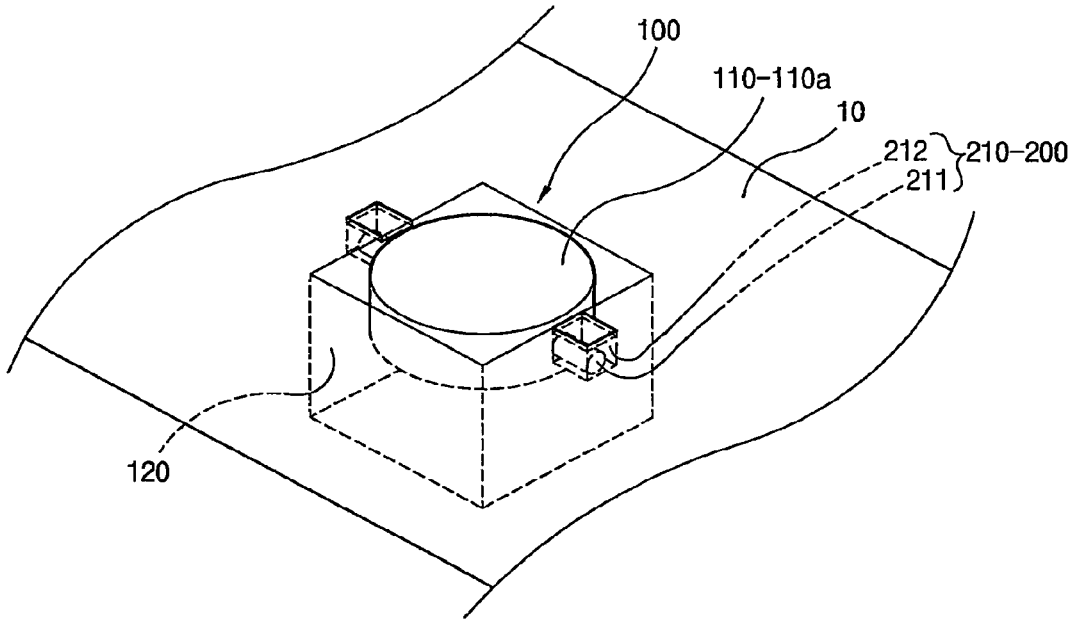
Figure 17:
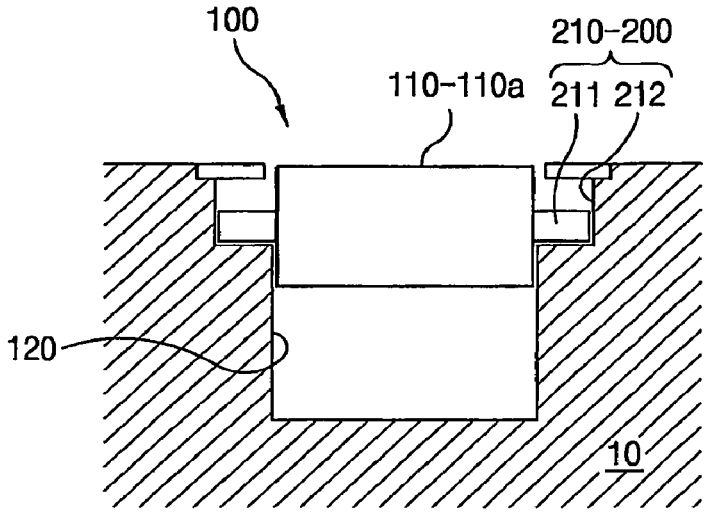

According to the first embodiment, as shown in FIGS. 16 and 17, the separation preventing means 200 can be realized by a rotational shaft 211 installed on a central area between both of the magnetic poles of the magnet 110, and a rotational shaft installation recess 212 formed on an inner surface of the magnet installation recess 120 so that the rotational shaft 211 is parallel with an outer surface of the body part 113.

That is the most general structure that can be ordinarily devised, and the rotational shaft 211 can be formed to pass through the central area of the magnet 110 and can be formed to be attached to both ends of the central area.

Here, the magnet 110 can have diverse shapes, however, it is preferable to be a permanent magnet 110*a* of cylindrical shape in consideration of the fact that it can enlarge the area of the joining surface exposed by the rotation.

Figure 18:
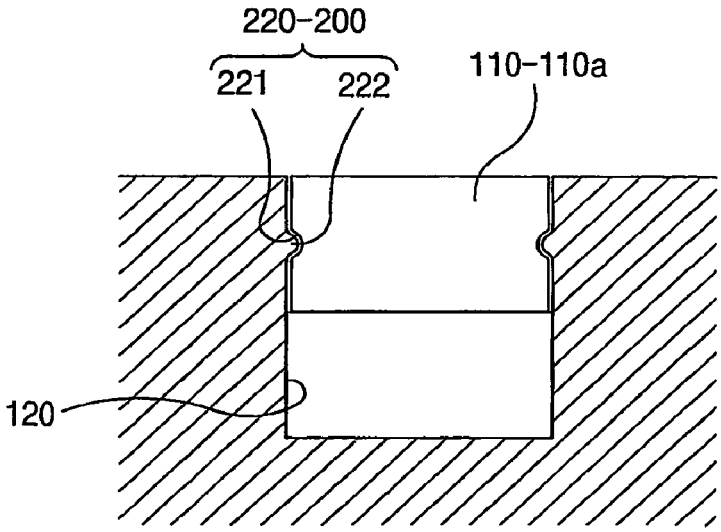

According to the second embodiment, as shown in FIG. 18, the separation preventing means 200 can be realized by a pair of recesses 221 formed on the surfaces opposite to each other at a central area of both magnetic poles of the magnet 110, and a pair of rotational shaft protrusions 222 formed on an inner surface of the magnet installation recess 120 so as to be inserted into the pair of recesses 221 while a virtual line connecting central positions of the pair of recesses 221 to each other is in parallel with an outer surface of the body parts 113.

The above is the construction contrary to the first embodiment, which has the advantage in that merely the recesses 221 are formed on the surface of the magnet 110.

In such a situation, the magnet 110 is also constructed by a permanent magnet 110*a* of cylindrical shape, and the reason of which is the same with that in the first embodiment.

Figure 19:
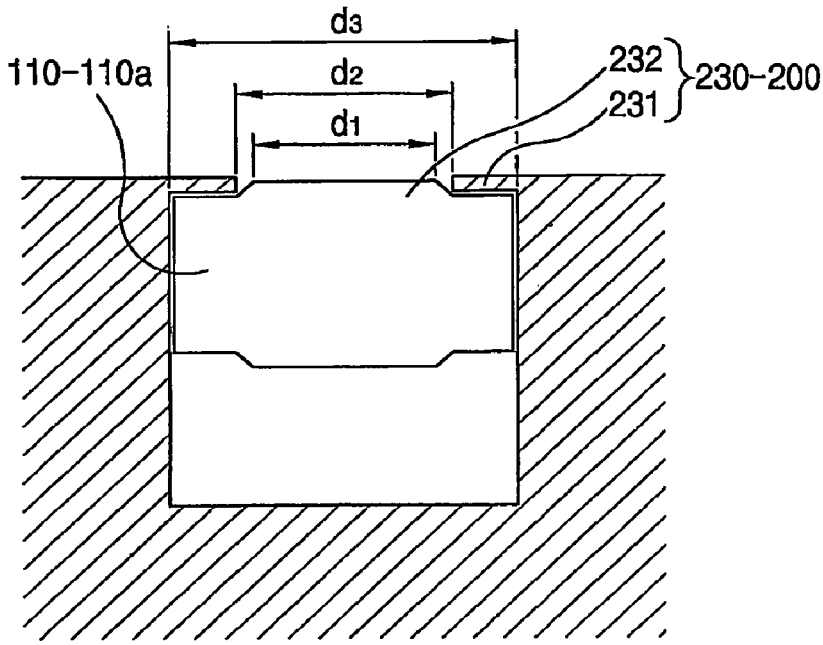
Figure 20:
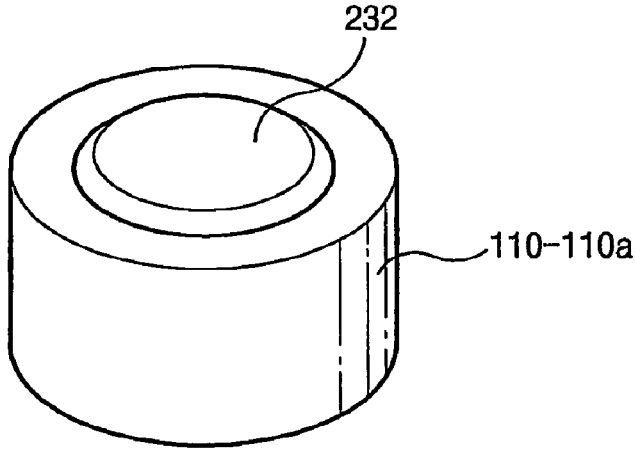

According to the third embodiment, as shown in FIGS. 19 and 20, the separation preventing means 200 can be realized by a hooking protrusion 231 for preventing the separation, which is formed on an opening of the magnet installation recess 120, wherein the inner diameter of the opening formed by the hooking protrusion 231 is narrower than a width and length of the magnet 110.

In other words, the separation of the magnet 110 is prevented by forming the hooking protrusion 231 for preventing the separation so as to have the inner diameter d2 narrower than the inner diameter d3 of the opening of the magnet installation recess 120 and narrower than the width and length of the magnet 110, and as the space in which the free rotation of the magnet 110 is allowed is formed in the hooking protrusion 231 for preventing the separation, when the poles of both magnet portions 100 joined with each other become the same, the construction that generates the attractive force by the different poles of both magnet portions 100 is made automatically.

Furthermore, since it is preferable that the joining surfaces of both magnets 110 are in contact with each other in order to strengthen the joining force between the magnets 110 of both magnet portions 100, it is effective that joining protrusions 232 having the diameter d1 smaller than the inner diameter d2 of the opening are formed on both poles of the magnets 110, and the protrusions 232 are protruded through the opening of the hooking protrusion 231 for preventing the separation when both of the magnets 110 are joined with each other.

In that situation, the structure of the magnet 110 is not restricted to a specific type if both of the poles thereof face directions different from each other so that the direction of the poles can changed by the rotation, however, it is preferable that the magnet 110 is a cylindrical permanent magnet 110*a* in order to achieve an easier and stabler joining with the magnet of other magnet portion.

According to fourth embodiment, as shown in FIGS. 21 to 24, the separation preventing means 200 is realized by a sealing lid 241 for closing the opening of the magnet installation recess 120.

That has the construction that the magnet 110 is not exposed outside and not contacted directly but joined with other component via the sealing lid 231 by the magnet force, whereby the magnet 110 is not be seen from the outside to induce the mysterious feeling of infant.

Accordingly, it is preferable that the sealing lid 241 is as thin as possible, and the sealing lid 241 can be made of any one of magnetic material and non-magnetic material.

Figure 21:
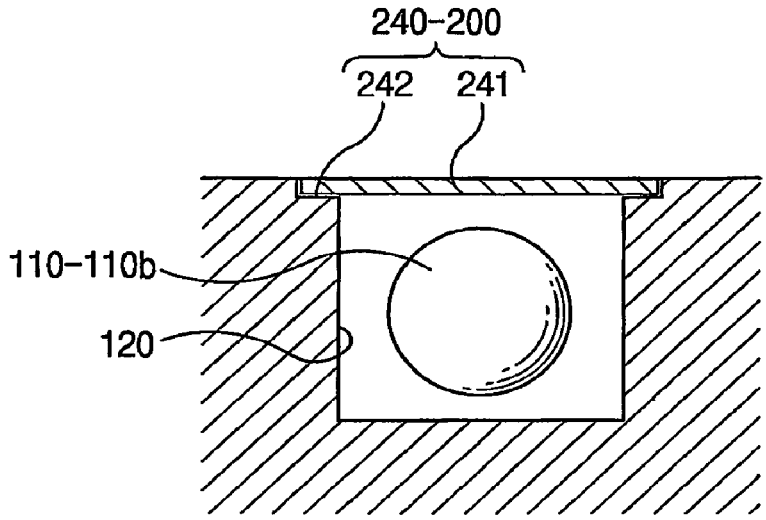

Furthermore, as shown in FIG. 21, it is preferable that the construction is employed in which a lid installation recess 242 for installing the sealing lid 241 is formed on the rim area of the opening of the magnet installation recess 120, since the sealing lid 241 is not protruded outside to form an overall planar shape.

Here, the magnet 110 is not restricted to a specific structure such as a cylindrical permanent magnet 110*a*, spherical permanent magnet 10*b*, etc.

If the cylindrical permanent magnet 110*a* is employed, there is an advantage that a strong joining force can be achieved as the contacting area is great when the magnets are joined, whereas there is a disadvantage that a sufficient inner space for rotation has to be secured in the magnet installation recess 120, and there are adverse advantage and disadvantage if the spherical permanent magnet 110*b* is employed.

Figure 22:
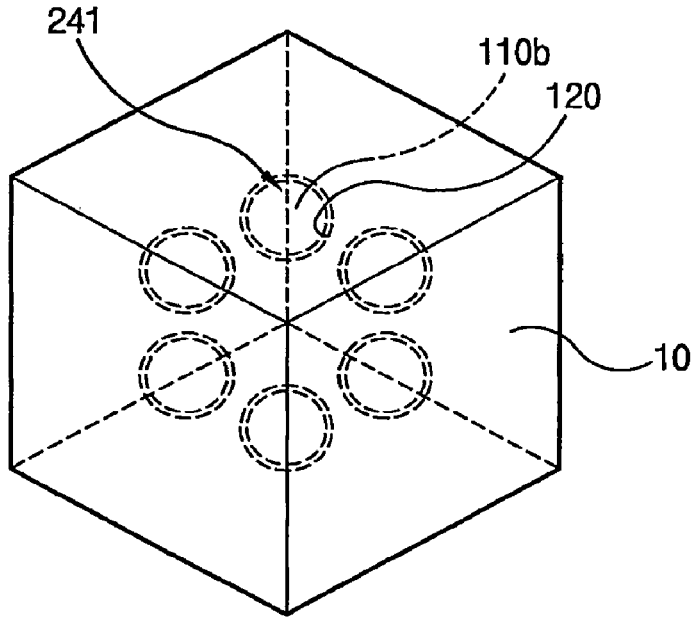
Figure 23:
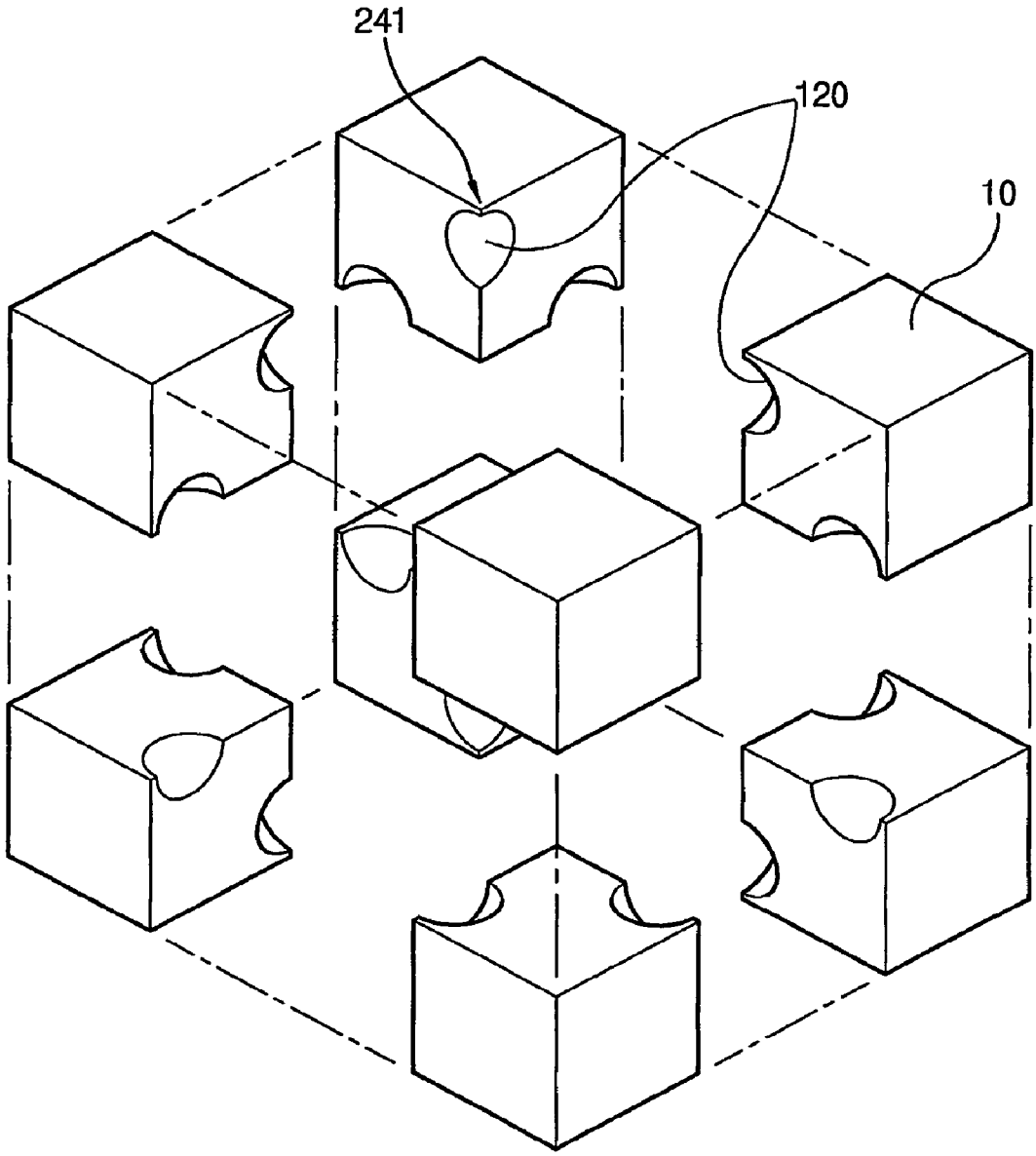
Figure 24:
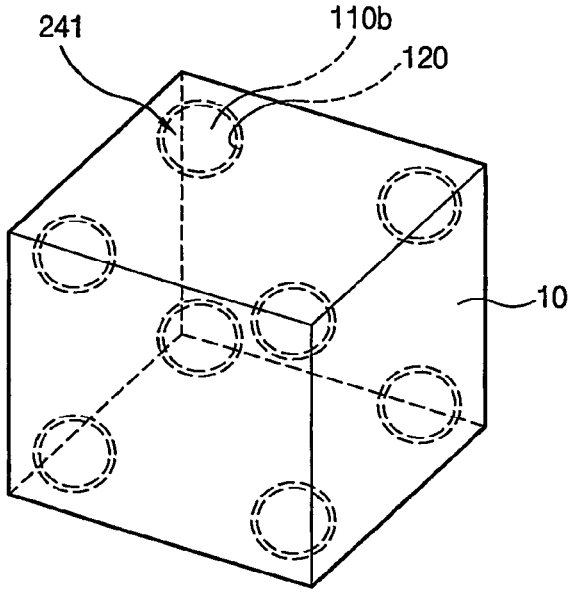

Furthermore, as shown in FIGS. 22 to 24, it is possible that the magnet installation recess 120 and the sealing lid 241 are formed integrally with each other near the outer surface of the part 10, and the magnet 110 is inserted after cutting the part 10, and then the separation of the magnet 110 is prevented by attaching a cut piece on the part 10.

As shown in FIG. 23, such a construction can be easily realized by cutting the part 10 made of a material such as wood along a predetermined line to form the magnet installation recess 120 on a certain area thereof, inserting the spherical magnet 110 into the magnet installation recess 120, and attaching the cut piece with adhesive or the like.

Moreover, as mentioned above, the toy for the infant is required not to be harmful even when the infant sucks with its mouth, and wood is the fittest material that meets such a requisition, however, wood has the drawback that it is hard to get a desired shape by injection molding as in the case of plastic.

In the present embodiment, the magnet 110 can be easily inserted into the inside of the body by the cutting and the adhesion, which realizes the magnet portion 100 that does not have such a drawback of wood.

FIGS. 22 to 24 is the embodiment of the part 10 having the magnet portion 100 realized by the above-described construction, in which FIG. 22 is a perspective view where the magnet portion 100 is formed near the central area of the outer surface of the part 10, and FIG. 24 is a perspective view where the magnet portion 100 is formed near the edge area of the part 10.

Here, the magnet 110 installed in the inside of the magnet installation recess 120 is not restricted to a specific structure such as a cylindrical permanent magnet 110*a*, spherical permanent magnet 110*b* or the like, and there are also advantage and disadvantage in respective cases as described above.

According to the fifth embodiment, as shown in FIGS. 25 to 33, the separation preventing means 200 can be realized by a magnet installation member 200*a* inserted into the magnet installation recess 120, and the magnet installation member 200*a* is comprised of a circumferential portion 201 of which surface is in contact with the magnet installation recess 120, and a lid portion 202 that closes the upper opening of the circumferential portion 201.

In other words, in the above four embodiments, the magnet 100 is directly installed in the magnet installation recess 120 of the part 10 while the rotation of the magnet 110 is allowed, and the means for preventing the separation of the magnet 110 is added to the part 10 itself, however, in the present embodiment, the magnet 110 is installed in the magnet installation recess 120 with a magnet installation member 200*a* that is manufactured separately.

Wood has the advantage that it can be used as the material of the toy for the infant and also has the disadvantage that it is hard to cut into a delicate shape, and the present embodiment provides a structure that is fit for the case of realizing the built-up type toy with wood like the fourth embodiment, in which a predetermined shape of magnet installation recess 120 is formed on wood and a separate magnet installation member 200*a* having the shape of wedge is inserted and fixed into the magnet installation recess 120.

Figure 25:
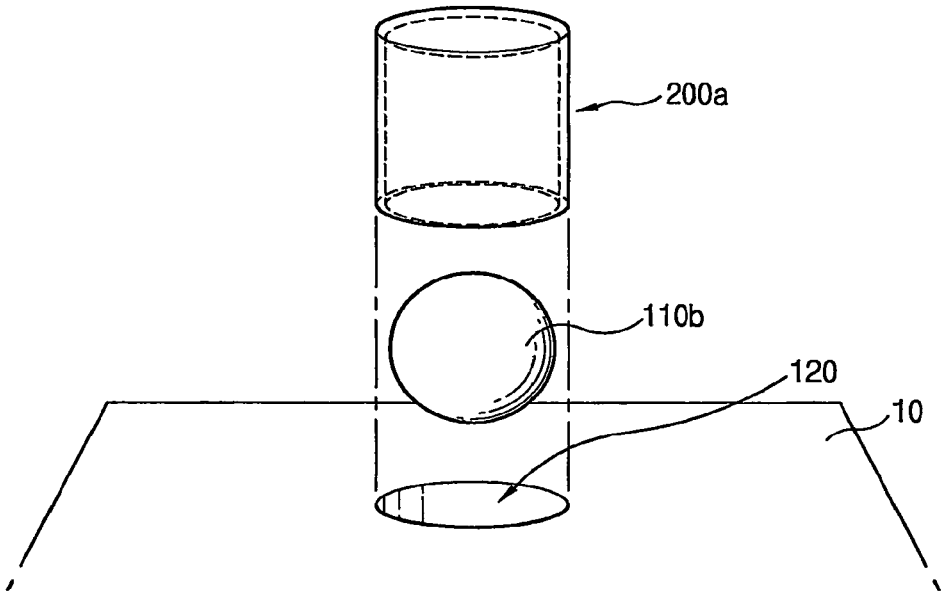

In other words, as shown in FIG. 25, while the magnet 110 is inserted into the inner space of the magnet installation member 200*a*, the magnet installation member 200*a* is inserted and fixed by hammering into the magnet installation recess 120 of the body made of wood, whereby the burden of cutting can be relieved even when the body is made of wood.

Here, the magnet 110 installed in the magnet installation member 200*a* is not restricted to a specific structure such as a cylindrical permanent magnet 110*a*, a spherical permanent magnet 110*b* or the like, and there are also advantage and disadvantage in respective cases as described above.

Meanwhile, the magnet installation member 200*a* itself may be separated from the magnet installation recess 120 of the part 10 since the magnet installation member 200*a* receives the force outward continuously as the built-up type toy according to the present invention is used repeatedly, and therefore, it is preferable that a separate magnet installation member fixing means 250 for fixing the magnet installation member 200*a* into the magnet installation recess 120 is further equipped in order to prevent such a phenomenon.

Hereinbelow, in the fifth embodiment that the magnet installation member 200*a* is employed as the separation preventing means 200, various modifications of the magnet installation member fixing means 250 for fixing the magnet installation member 200*a* will be described.

Figure 26:
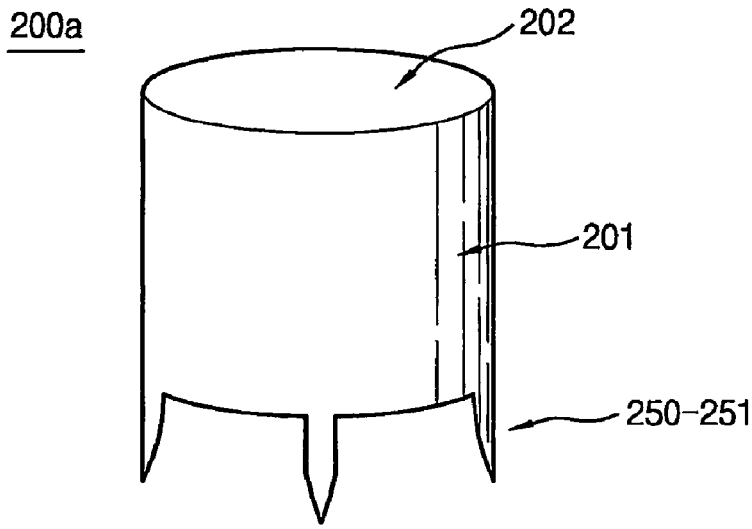

According to the first modification, as shown in FIG. 26, the magnet installation member fixing means 250 can be realized by a fixing wedge portion 251 extended downward of the circumferential portion 201 so as to be inserted and fixed onto the bottom surface of the magnet installation recess 120.

Such a construction is to fix the magnet installation member 200*a* into the magnet installation recess 120 by striking with a hammer or the like when the part 10 is made of wood or the like.

According to the second modification, as shown in FIGS. 27 to 30, the magnet installation member fixing means 250 can be realized by hooking protrusions 252 formed outward on the outer surface of the circumferential portion 201 toward the lid portion 202.

The hooking protrusions 252 do not have influence on the insertion of the magnet installation member 200*a* into the magnet installation recess 120 as they are formed toward the lid portion 202, however, since the protrusions 252 cause a frictional resistance with respect to the inner surface of the magnet installation recess 120 while the inserted/fixed magnet installation member 200*a* is moving toward the lid portion 202, i.e., toward the upward direction, there can be achieved the effect that the magnet installation member 200*a* is fixed stably in the magnet installation recess 120.

Figure 27:
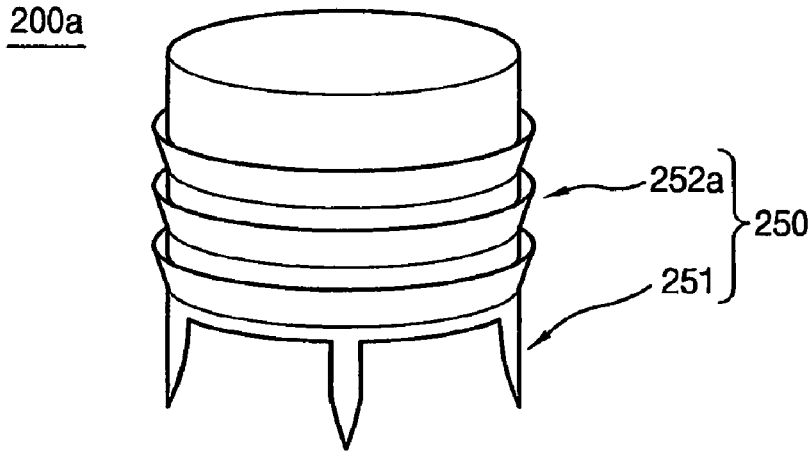
Figure 28:
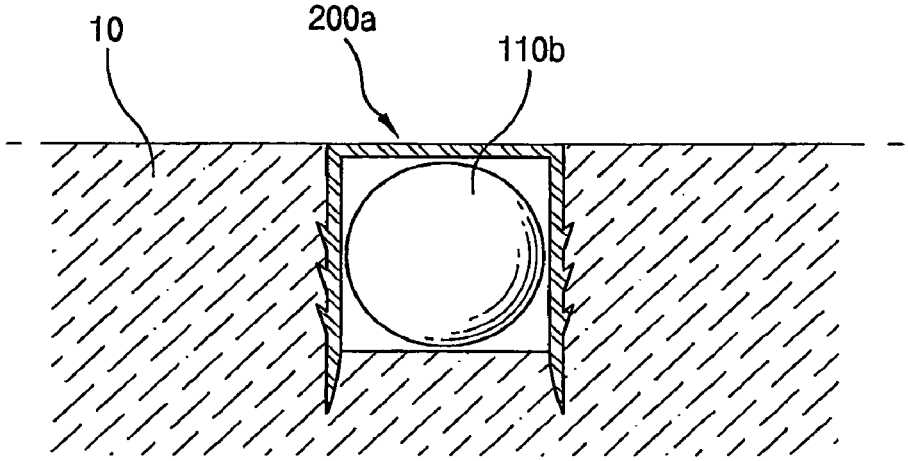

As shown in FIGS. 27 and 28, the hooking protrusions 252 can be formed as overall hooking protrusions 252*a* formed over all area of the outer surface of the circumferential portion 201 at a shape of a wedge.

Figure 29:
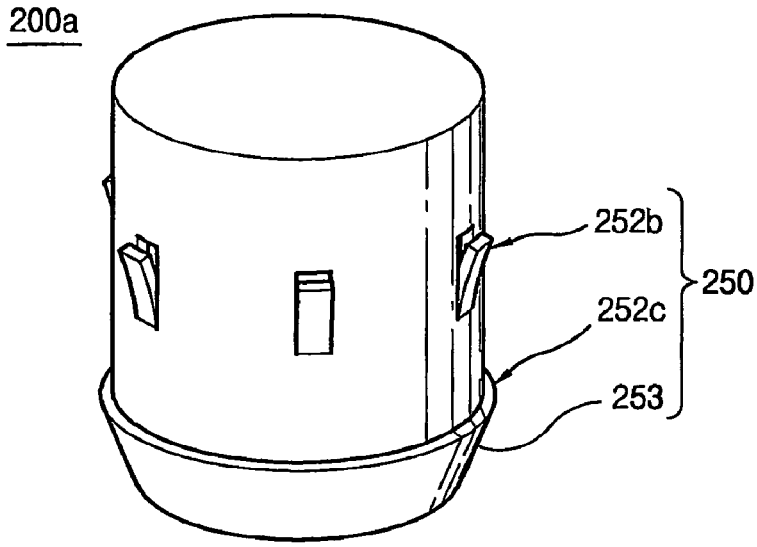
Figure 30:
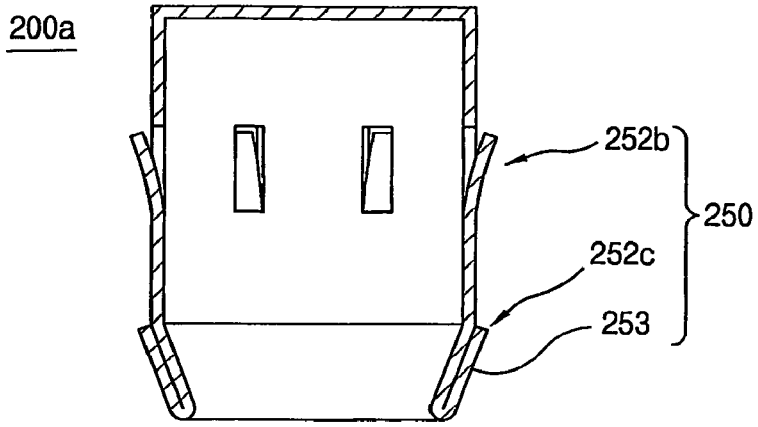

Furthermore, as shown in FIGS. 29 and 30, the hooking protrusions 252 can be formed as partial hooking protrusions 252*b* formed on a partial area of the outer surface of the circumferential portion 201.

Such partial hooking protrusions 252*b* can be formed by installing a separate member on the outer circumference of the circumferential portion 201, however, as shown in the figure, it is preferable that the partial hooking protrusions 252*b* are formed by cutting and bending a part of the circumferential portion 201 in consideration of the stability of the structure.

Furthermore, the hooking protrusion 252 can be formed as a lower hooking protrusion 252*c* formed on a lower end area of the outer surface of the circumferential portion 201, and in such a situation, it is preferable that the hooking protrusion 252 further has a tilted portion 253 that is tilted downward and inward from the lower hooking protrusion 252*c* at a certain degree.

When such a tilted portion 253 is employed, as the area of the transverse section of the lower end part of the magnet installation member 200*a* is smaller than the area of the transverse section of the upper opening of the magnet installation recess 120, it is easier to insert and fix the magnet installation member 200*a* into the magnet installation recess 120.

Furthermore, as shown in FIG. 30, the lower hooking protrusion 252*c* and the tilted portion 253 can be formed integrally with each other by bending a lower portion of the circumferential portion 201 in consideration of the stability of the structure or the workability.

Figure 31:
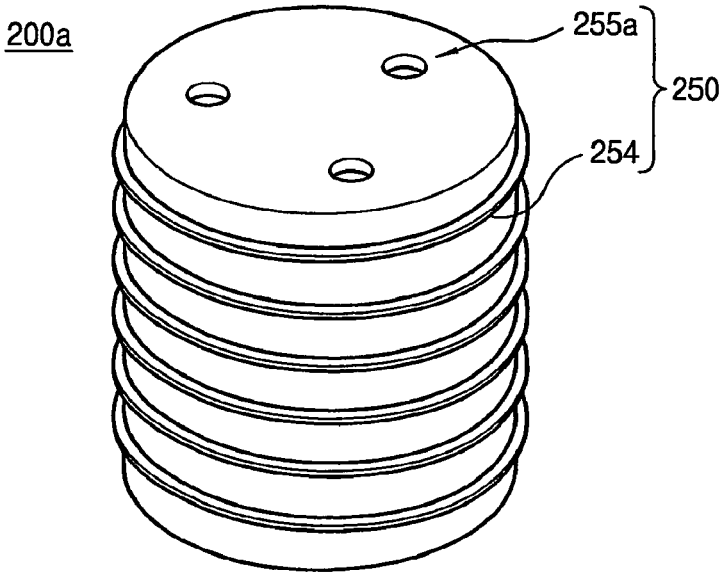
Figure 32:
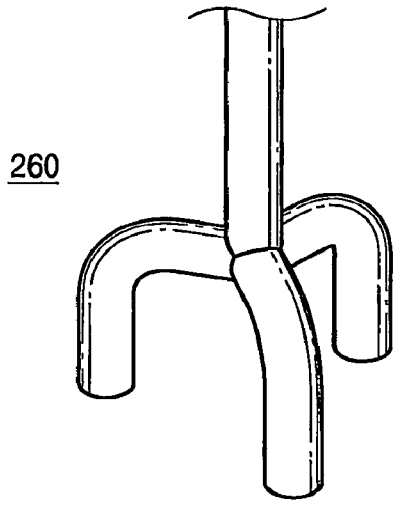
Figure 33:
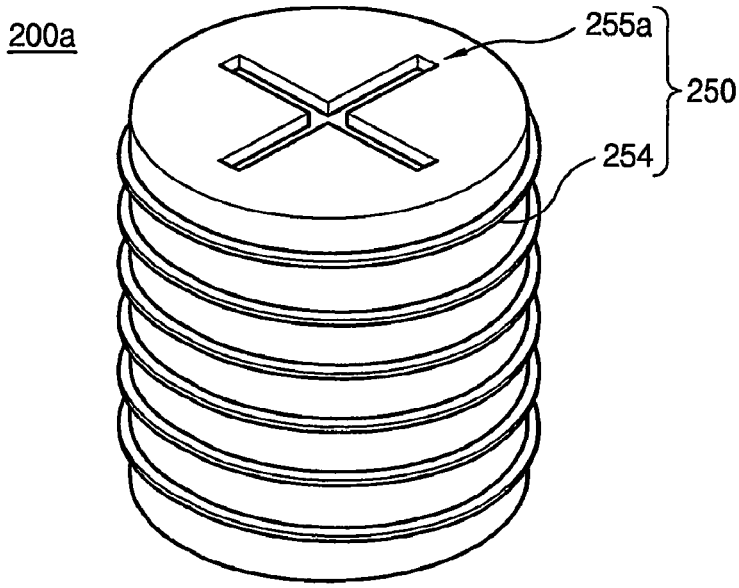

According to the third modification, as shown in FIGS. 31 to 33, the magnet installation member fixing means 250 can include a screw thread 254 formed on the outer surface of the circumferential portion 201.

That is the example that the magnet installation member 200*a* is inserted and fixed into the magnet installation recess 120 by the screwed assemblage, which provides the advantage that a stabler structure can be achieved in comparison with the above modifications.

In case the structure according to the above example is employed, it is preferable to add a structure that makes it easier to insert the magnet installation member 200*a* by rotation.

In other words, it is preferable that the magnet installation member fixing means 250 has a fixing tool insertion recess 255 so formed on an upper surface of the lid portion 202 as to insert the magnet installation member 200*a* into the magnet installation recess 120 by rotating the magnet installation member 200*a* with a magnet installation member fixing tool 260.

The fixing tool insertion recess 255 can be modified to a variety of shapes according to the structure of the fixing tool.

For example, when a cross type driver is used as the fixing tool, the insertion recess 255*b* of cross-shaped transverse section will be employed as shown in FIG. 33.

Meanwhile, the fixing tool insertion recess 255 is formed to a structure considering the appearance according to the usage of the toy since it is exposed outside the toy, and the magnet installation member fixing tool 260 is selected properly in consideration of the shape of the fixing tool insertion recess 255.

For example, if a plurality of insertion recess 255*a* having the circular cross section are formed in a radial fashion as shown in FIG. 31, the insertion by rotation of the magnet installation member 200*a* can be easily performed with the magnet installation member fixing tool 260 having the construction as shown in FIG. 32.

That is, the fixing tool insertion recess 255 can be formed on the magnet installation member 200*a* in consideration of the appearance of the toy, while achieving the object to make it easy to insert the magnet installation member 200*a*.

Furthermore, the examples that the joining apparatus with the rotatable magnet according to the present invention is adopted to the built-up type toy that have been illustrated so far, however, the technical concept of the present invention that the attractive force can be generated irrespective of the poles by a simple structural variation that makes the magnet rotatable can be employed to any cases requiring a simple assembly and disassembly without any adhesive.

The preferred embodiment of the present invention has been described so far. It will be understood by those skilled in the art that the present invention should not be limited to the described preferred embodiment, but various changes and modifications can be made within the spirit and the scope of the present invention. Accordingly, the disclosed embodiments should be considered not in the restrictive point of view but in the illustrative point of view. The scope of the present invention is not limited within the range described in the above description but the following claims, and all of the differences in the range substantially the same with that should be considered to be included in the present invention.

The present invention provides a built-up type toy having the construction that the assembled shape is not demolished easily as well as the initiative of infant can be developed by the diverse assembled shape.

What is claimed is:

1. A built-up type toy having a plurality of parts of polyhedron shape equipped with joining surfaces that are joined with other joining surfaces of other parts, the built-up type toy comprising:

the parts respectively having magnet portions on the joining surfaces thereof;

wherein the magnet portion of the part and the magnet portion on the joining surface of the parts are joined with each other by magnetic force thereof, and wherein the magnet portion comprises:

a magnet of which both magnetic poles are arranged to face directions different from each other, the magnet being installed on a magnet installation recess formed on the part; and a separation preventing means for preventing a separation of the magnet from the magnet installation recess while allowing a rotation of the magnet in the inner space of the magnet installation recess, wherein the separation preventing means comprises:

a rotational shaft installed on a central area between both of the magnetic poles of the magnet; and a rotational shaft installation recess formed on an inner surface of the magnet installation recess so that the rotational shaft is parallel with an outer surface of the part.

2. The built-up type toy of claim 1, wherein the magnet is a permanent magnet of cylindrical shape.

3. The built-up type toy of claim 1, wherein the magnet portion is formed on a central area of the joining surface of the part.

4. The built-up type toy of claim 1, wherein a plurality of magnet portions are formed on each joining surface of the part.

5. The built-up type toy of claim 4, wherein the magnet portions are formed all of the joining surfaces of the part.

6. The built-up type toy of claim 1, wherein the parts form a character, a number, a symbol, a diagram, or a certain shape on a plane thereof as the parts are joined with other parts.

7. The built-up type toy of claim 1, wherein the parts are comprised of a plurality of hexahedrons having shapes and sizes identical to each other.

8. The built-up type toy of claim 7, wherein the part comprises:

a central part c having a circular transverse section and having a plurality of magnet portions arranged on an outer surface thereof at a predetermined interval; and a plurality of fragmental parts and having a fan-shaped transverse section, the fragmental parts and respectively having a magnet portion corresponding to the magnet portion on the outer surface of the central part, and magnet portions being joined with the magnet portions of other fragmental parts on both side thereof, wherein a cylindrical shape is formed as the central part is located on a central position and inner surfaces of the plurality of fragmental parts and are joined on the outer surface of the central part.

9. The built-up type toy of claim 1, wherein the parts realize a variety of three-dimensional shapes as being joined with other parts.

10. The built-up type toy of claim 9, wherein the magnet portion is formed on an edge area of the joining surfaces of the part.

11. The built-up type toy of claim 9, wherein a plurality of magnet portions are formed on each of the surface of the part.

12. The built-up type toy of claim 11, wherein the magnet portions are formed on all of the joining surfaces of the part.

13. The built-up type toy of claim 9, wherein the parts comprise:

a rotational shaft part having a shape of a bar and formed with the magnet portions on both ends thereof; and a wheel part formed with the magnet portion g joined with the magnet portion f of the rotational shaft part on a central area thereof.

14. The built-up type toy of claim 9, wherein the parts comprise:

a fragmental part having a detached shape achieved by detaching a section from an overall shape of joined product; and a body part having a residuary shape achieved by detaching the fragmental parts from the overall shape of the joined product.

* * * * *